United States Patent [19]

Ducresot et al.

[11] 4,219,102

[45] Aug. 26, 1980

[54] METALLIC LADDERS

[75] Inventors: Pierre Ducresot, Guerigny; Catherine Archer, Villennes sur Seine, both of France

[73] Assignee: S.A.R.L. dite: F.M.C. Fabrications Metallique de Cizely, Colombes, France

[21] Appl. No.: 79

[22] Filed: Jan. 2, 1979

[30] Foreign Application Priority Data

| | | | |
|---|---|---|---|
| Jan. 2, 1978 | [FR] | France | 78 00588 |
| Apr. 17, 1978 | [FR] | France | 78 11808 |
| Jun. 2, 1978 | [FR] | France | 78 17233 |
| Nov. 24, 1978 | [FR] | France | 78 34039 |

[51] Int. Cl.[2] ..... E06C 7/08; E06C 7/50

[52] U.S. Cl. ..... 182/220; 182/228; 182/219

[58] Field of Search ..... 182/228, 200, 194, 219, 182/217, 215, 220; 403/263, 242, 347

[56] References Cited

U.S. PATENT DOCUMENTS

| | | | |
|---|---|---|---|
| 2,618,427 | 11/1952 | Langley | 182/228 |
| 3,004,625 | 10/1961 | Arnold | 182/228 |
| 3,608,256 | 9/1971 | Jefferys | 182/228 |
| 3,653,697 | 4/1972 | Ernst | 182/228 |
| 3,997,027 | 12/1976 | Patterson | 182/178 |

FOREIGN PATENT DOCUMENTS

| | | | |
|---|---|---|---|
| 1459289 | 10/1966 | France | 182/228 |

*Primary Examiner*—Reinaldo P. Machado
*Attorney, Agent, or Firm*—Karl F. Ross

[57] ABSTRACT

A metallic ladder includes stiles (or side rails) of U or I section and rungs which are supported at each end by a reinforcing plate. The stiles have, in section on each longitudinal wall a flange which is spaced inwardly with respect to a free edge of the respective longitudinal wall so as to form a ridge. The reinforcing plates rest on the flanges and are restrained laterally by the ridges. The reinforcing plates are held at the flanges by a tab and opening arrangement. Each rung has a shoulder adjacent each end which contacts either the reinforcing plate or the web of the stile and the extreme end portion of the rung engages correspondingly in the web or the plate.

12 Claims, 19 Drawing Figures

1
2b
2c
2
4
1c
1d
6
1b
5
7
2a
3
1a
2e
7°5
III
II

METALLIC LADDERS

BACKGROUND OF THE INVENTION

1. Field of the invention

The invention relates to metal ladders.

2. Description

The stiles of metal ladders are, in general, tubular, with a closed profile, in order to impart to them a high resistance to lateral forces. However, such stiles have to be provided with openings for the passage of rungs and the openings are difficult to machine. Furthermore, it is well known to the man skilled in the art that tubular profiles are heavier than open profiles.

Ladders are also known of which the stiles are constituted by simple open profiles of C or I section. These ladders are easy to manufacture, and less heavy then those of which the stiles are of closed profile. However, the connection between the stiles and the rungs gives rise to a weak joint, the web of the profiled members forming the stiles, on which the rungs are fixed, readily deforms under the action of forces to which the ladder is submitted when in use. In particular, the ladder deforms laterally when the user is at mid-height, which can give rise to a feeling of insecurity.

In order to overcome this disadvantage, it has been proposed in French Pat. No. 1,501,748 to reinforce the stiles at the region of each of the ends of the rungs, by a reinforcing plate secured to the stile by the formation at the edges of each reinforcing plate of flanges which are engaged by longitudinal flanges of these stiles or surround the longitudinal flanges, the outer flanges being inserted into the inner flanges.

However, the various reinforcing plates must be threaded at one of the ends of the stile, which is time-consuming and costly. When the stiles are of treated aluminum, there is a risk of cracking during the engagement of the flanges, which may cause dangerous starting points for complete failure. In addition the reinforcing plates are poorly secured longitudinally. In order to prevent the sliding of the reinforcing plates, provision is made in U.S. Pat. No. 1,501,748 for the machining on the surrounding flanges, bosses which act to deform the flanges which are engaged; but these bosses are of little value and may give rise to cracking of the stiles.

The present invention has for its object a ladder of which the rungs are of open profile, and reinforced by reinforcing plates in the region of each of the ends of certain of the rungs at least, and in which the reinforcing plates are adequately secured.

SUMMARY OF THE INVENTION

According to the present invention there is provided a metal ladder comprising two spaced stiles of open section, a plurality of rungs extending between the stiles, and having a shoulder at each end, and reinforcing plates each receiving an end portion of a rung in an opening thereof, and each including tab means, each said stile having a web, with openings for the rungs, two longitudinal walls, one wall extending from each edge of the web, and each longitudinal wall having a flange spaced inwardly from the free edge of the longitudinal wall so as to define a ridge, each said flange having apertures therein spaced along its length, each said rung being fitted in a said opening of the web and in a said opening of a said reinforcing plate, and the tab means of the reinforcing plates being secured in the apertures of the flanges.

By means of this construction, the reinforcing plates are properly secured in the stiles. The plates are restrained from transverse displacement by the ribs and longitudinal displacement by the tabs; the shoulder of the rung holds it on the ribs. Moreover, these ribs prevent turning of the rung and the tabs, engaged in the flanges of the stiles, prevent the lateral walls of the latter from becoming deformed and becoming further spaced from one another, which would permit displacement of the reinforcing plate with respect to the stiles; in this way the stile thus constitutes a non-deformable box.

The reinforcing plate may be disposed within the stile, the rung traversing first the reinforcing plate, then the web of the stile. However, the opposite arrangement is possible, that is to say, the reinforcing plate may be disposed on the outside of the stile, the rung traversing first the web of the stile and then the reinforcing plate.

The teeth or tabs of the reinforcing plate may be simply threaded into the openings of the flanges of the stile; they may also be bent back beneath these stiles, after location of the reinforcing plate.

The teeth or tabs preferably have the same width as the openings formed in the flanges, so as to prevent the displacement of the reinforcing plate not only downwardly, but also upwardly. In a modification, the teeth or tabs are trapezoidal, while having a maximum width substantially equal to the width of the openings of the flanges so as to fit in the openings of the stiles; this shape facilitates, moreover, the easy engagement of the tabs in the openings.

The transverse edges of the reinforcing plate may comprise a fold substantially perpendicular to the plate. Owing to this arrangement, the reinforcing plate does not need to be centered during the securing of the rung to the stile.

The reinforcing plate may comprise strengthening ribs disposed substantially as diagonals.

In general, the metallic ladder is of aluminum. Now, aluminum resists impact only poorly and because of this phenomenon, the opening provided in the reinforcing plate, or the stile, for the passage of the rung may become oval as a result of the impacts produced by personal weights. A clearance is thus formed between the rung and the reinforcing plate or the stile, which reduces the strength of the ladder.

In order to overcome this disadvantage, the opening may be constituted by a recess. The contact between the rung and the reinforcing plate, or the stile, thus provides a certain surface, which avoids any impact loading. Moreover, the recess stiffens the plate and facilitates the fitting of the rung. This recess may be directed inwardly or outwardly of the latter.

The shoulder may be constituted by a portion of reduced section formed at the end of the rung, over a length somewhat in excess of the distance separating the reinforcing plate from the web of the stile. This portion of reduced section is of use, even if the tabs are folded under the reinforcing plate and hold the latter. In practice, the rungs are produced by spinning and their section is not precise. The provision of the reduced section portion enables, however, a true calibrating operation. As the hole or the recess provided in the reinforcing plate or the stile is also calibrated, the precision of the assembly is high. When forming the reduced section portion simultaneously at the two ends of the rung, a rung is produced of which the two ends are exactly parallel, which is very difficult to obtain with a conventional profiled member made by spinning, because of the slight bending of this profiled member produced at the time of its manufacture.

The reduced section portion is preferably frusto-conical; it should be understood, however, that the section of the frusto-conical reduced section portion is not necessarily circular, but it corresponds to that of the rung, the latter being for example triangular with rounded angles. In practice, it is then simple to engage the end of the rung in the hole which is formed in the stile, or in the reinforcing plate, and which has dimensions slightly in excess of those of this end portion. The conicity of the reduced section portion takes up the play existing between the hole and the periphery of the rung so that the periphery of the rung comes exactly into abutment against the edge of the hole, and which enables a good fit with the end portion of the rung.

In order that a ladder should resist bending, it is necessary, either that the rungs cannot turn with respect to the stiles, or that the stiles should not be able to twist between two rungs. A ladder with tubular stiles cannot twist because the stiles themselves cannot twist, even if a slight rotation of the rungs with respect to the stiles is possible. On the contrary, if the stiles of the ladder are open profile, as is the case for ladders according to the invention, it is absolutely necessary that the rungs should not be able to turn with respect to the stiles so that the ladder resists twisting.

When the reinforcing plates are disposed within the stiles the rungs are connected to these stiles through the intermediary of the reinforcing plates; it is thus necessary so that the above condition should be fulfilled, that the reinforcing plates do not have any play with respect to the rungs, which is put into practice according to the invention, and that the rungs absolutely cannot turn with respect to the reinforcing plates. When the reinforcing plates are disposed at the outside of the stiles, it is necessary that the rungs should not turn with respect to these stiles.

According to a further feature of the preferred embodiments which avoids this turning, each of the ends of the rung have a frusto-conical reduced section portion and the opening formed in the reinforcing plate, or the stile, for the passage of the rung has the form of a frusto-conical recess, the cone angle of the recess being equal to that of the reduced section portion. There is thus produced an intimate contact of the rung and of the reinforcing plate, or of the stile, on a relatively large surface, which assists in preventing any turning of these two elements with respect to one another. The recess being in the form of a funnel and having a section which is larger than that of the rung, the locating of the rung is very simple. Moreover, the hole formed in the stile, or in the reinforcing plate, has a section substantially smaller than that of the main portion of the rung, so that the hole gives rise substantially to no weakening of the stile.

The effect of this feature is further enhanced in the case where the reinforcing plate is on the inside of the stile, if this reinforcing plate is grooved. In practice, it cannot then deform and the rung is rendered totally rigid with the stile, the latter including the flanges of the stile and not simply the web thereof.

Fitting of the end of a rung on the web of the stile or on the reinforcing plate, is preferably, effected by an angular riveting or peening machine which forms a flange on this end.

There may be provided in the middle part of the ladder, a common reinforcing plate extending over two rungs or preferably, for example, over a quarter or a third of the total length of the ladder. This arrangement reinforces the ladder over the part which suffers the highest loads; or for equal strength, the weight of the ladder can be reduced.

Experience shows that the fitting of the reduced section end portion of the rung is effected correctly at angles, but less well in the plane parts which connect these angles, in particular when this fitting is effected with the aid of an angular riveting (peening) machine. Now, in order that the ladder should resist adequately, the various loads to which it is subjected, it is necessary that the rungs should be perfectly secured with respect to the stiles which is assisted by the use of a fitting or engagement technique which is effected correctly over the whole of the periphery of the rung.

To this end, a further feature of the preferred embodiment provides that each reduced section end portion of the rung has a longitudinal depression in each of its parts corresponding to a substantially plane part of the rung. The profile of this end portion of reduced section thus has formed therein no rectilinear parts, which ensures a good fit.

A disadvantage of a conventional metallic ladder with respect to traditional wooden ladders, is that the central part of the ladder oscillates laterally, which is unpleasant for a user. In order to measure the resistance "laterally" of a ladder, the ladder is arranged vertically with one stile above the other in such a manner that one of its stiles is arranged horizontally on two fixed supports, and a vertical force is then applied in the region of the other one of the stiles, and the sag or deflection of this stile is measured.

If a destructive test is carried out on the ladder, that is to say, if there is applied on the second stile a force such that the ladder is destroyed, it has been established that it is the ends of the stiles at the region of the rungs which are the first to be destroyed. The rungs at the ends literally reinforce the stiles and tend to come out to the outside of them. If the rung comprises on the inside of the stile, a flange or a projecting part, this flange or projecting part tears the internal face of the stile or the reinforcing plate and the riveting or other setting of the rung on the stile is destroyed.

According to a further feature of one preferred embodiment, a spacer ring or sleeve of which the thickness is substantially equal to the distance separating the reinforcing plate and the central part or web of the stile, is disposed between this reinforcing plate and this central part and threaded on to the end of the rung.

This spacer prevents the reinforcing plate from deforming when the rung is subjected to a bending force in the plane of the stile. Moreover, the shoulder provided on the inside of the stile cannot break the reinforcing plate. If one proceeds to a destructive test of the ladder "laterally" it has been established that it resists a force which is four or five times greater than that giving rise to the destruction of a ladder of which the rungs are not provided with spacers. During normal use of the ladder, it does not deform in the lateral sense. The hole for the passage of the spacer has, preferably, the shape and the dimensions of the outer profile of the rung so that the latter will be tightly gripped.

The height of the spacer is preferably substantially equal to that of the reinforcing plate, in which case this spacer reduces the forces which are exerted on the teeth or tabs of the reinforcing plate when the ladder is submitted to a lateral or a torsion force. The spacer may be solid or hollow on either side of the passage hole of the rung. Its upper faces and lower faces preferably have a width substantially equal to the spacing between the stiles of the ladder.

When the spacer is hollow and defined by two relatively narrow upper and lower faces, each of these faces advantageously comprises one or several ribs spaced from the edge and extending in the direction of the thickness of the spacer. This rib stiffens the corresponding edge of the spacer while avoiding its splaying out and enables fixing of the spacer with respect to the reinforcing plate by local deformation of the reinforcing plate into the rib. The spacer may be of metal or even of moulded plastics material. In the latter case it preferably comprises, on the face directed towards the reinforcing plate, two flanges which are spaced from one another by a distance substantially equal to that of the web of the said reinforcing plate. These flanges define recesses in which the reinforcing plate is encastré. The edges of the reinforcing plate have angles which are always more or less sharp, in particular when this reinforcing plate is cup-up or sawn off from a profiled member, cannot then damage the fingers of the user when he climbs or descends by holding the stiles of the ladder; moreover, they secure the spacer with respect to the reinforcing plate, when the latter is secured to the stiles.

DESCRIPTION OF THE PREFERRED EMBODIMENTS

Figures 1, 2, 3, 4, 5:
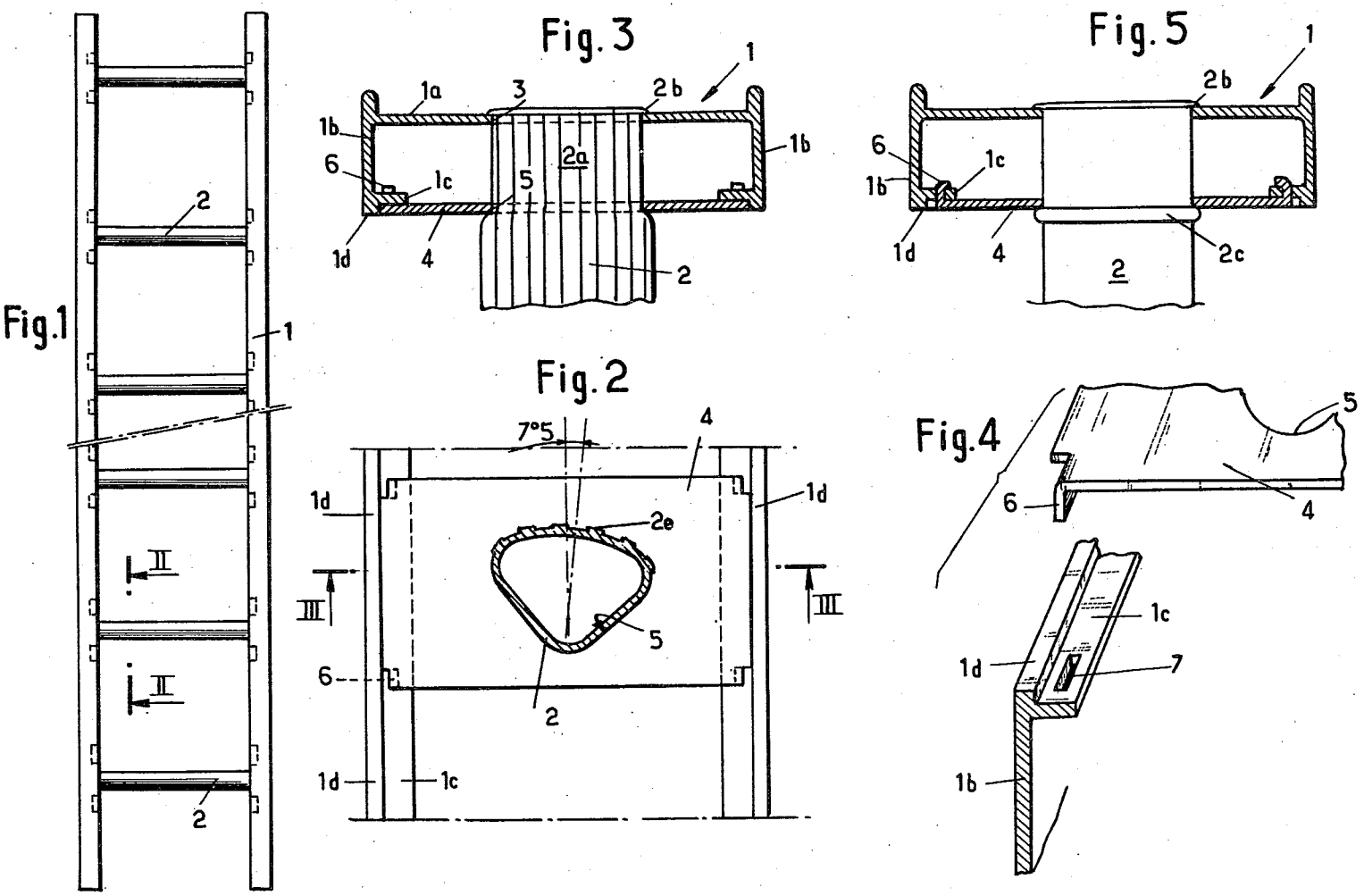
FIG. 1 is an elevational view of a ladder embodying the invention.
FIG. 2 is a section on the line II—II of FIG. 1, to an enlarged scale.
FIG. 3 is a section on the line III—III of FIG. 2.
FIG. 4 is a fragmentary perspective view of a detail of a reinforcing plate and a part of one of the stiles of the ladder.
FIG. 5 is a view similar to that of FIG. 3 of a modification.

As is shown in FIGS. 1 to 4, the ladder according to the invention comprises side rails or stiles 1 and tubular rungs 2.

Each of the stiles 1 is constituted by a profiled member of substantially U or I section. The central part or web 1*a* of this profiled member is provided with openings 3 for the passage of rungs 2 and each of its lateral walls 1*b* is provided with a flange 1*c* parallel to the web 1*a*; this flange is spaced inwardly with respect to the edge of the wall 1*b*, and forms a rib or ridge 1*d* beyond this flange.

In the region of each rung 2 each of the stiles 1 is closed by a reinforcing plate 4 which rests on the flanges 1*c*, extends from one ridge 1*d* to the other, and is provided with an opening 5 for the passage of the rung. Tabs or tongues 6 are cut in the lateral edges of each reinforcing plate 4 at the ends of these edges, and are folded so as to be perpendicular to the reinforcing plate or slightly divergent from the perpendicular; they are engaged in openings 7 of similar width, of the flanges 1*c*.

At each of its ends, the rung 2 has a reduced section portion as indicated at 2*a*, with a length slightly greater than the spacing between the reinforcing plate 4 and the central part of 1*a* of the stile 1. The shape and the dimensions of the openings 3 and 5 correspond to those of the reduced section end portion, so that the part of the rung disposed adjacent to this end cannot pass through the reinforcing plate 4 and abuts against the latter. Once the reinforcing plate 4 has been placed in the stiles by engagement of the tabs or tongues 6 in the openings 7, the rung is introduced into the openings 3 and 5 and its end edge is inserted into the interior of the central part 1*a*, as is seen at 2*b*. The reinforcing plate 4 is thus secured to the stile and prevented from becoming displaced therefrom.

In the embodiment illustrated, the rung 2 has a generally triangular section, with rounded angles, so that it cannot turn in the openings 3 and 5. The perpendicular to the plane support portions 2*c* makes an angle of 7° to 8° with the longitudinal direction of the stiles 1. The upper face of the rung is provided with longitudinal ribs or ridges 2*e* which assist in preventing the feet of the user from slipping.

In the modification of FIG. 5, the tabs 6 are folded back beneath the flanges 1*c*. Moreover, the end of the tube 2 is not of reduced section; however, this tube comprises a bead 2*c* abutting the outer face of the reinforcing plate 4. This bead 2*c* may also be provided in the embodiment of FIG. 3, in which the tabs are not bent back.

Figure 6:
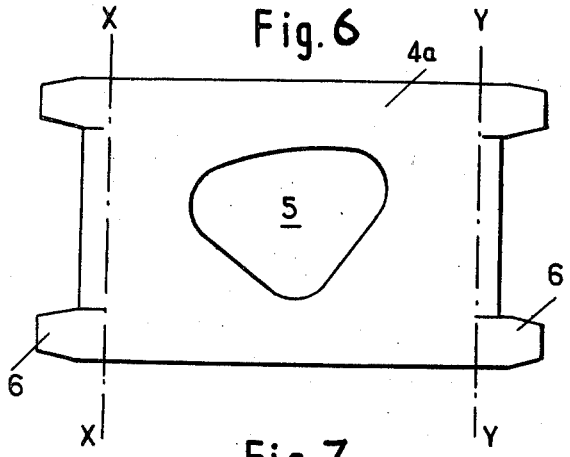
FIG. 6 is an elevational view of a particular embodiment of the reinforcing plate, before its tabs have been folded.

In FIG. 6, the reinforcing plate 4*a* with its opening 5 is shown flat before folding of the tabs 6. The latter which are cut in the plate and subsequently folded on the line X—X and Y—Y are of trapezoidal shape.

Figure 7:
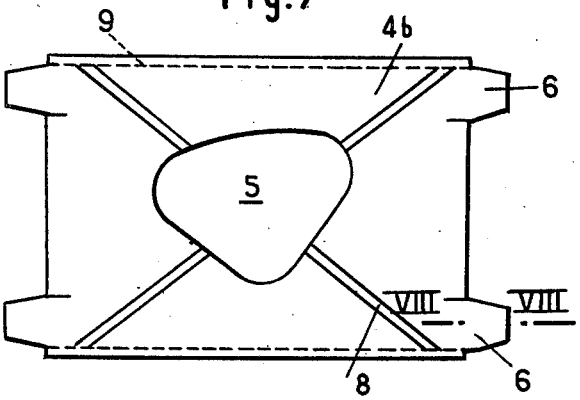
FIG. 7 is a view similar to FIG. 6 of another embodiment of reinforcing plate.
Figure 8:
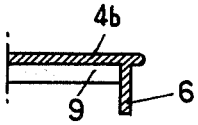
FIG. 8 is a view in section on line VIII—VIII of FIG. 7 after folding of the tab.

In FIGS. 7 and 8, the reinforcing plate 4*b* has a shape similar to that of the reinforcing plate 4*a*, but it is provided with diagonal ribs 8. Moreover, each of the transverse edges of this reinforcing plate comprise a fold 9 substantially perpendicular to this reinforcing plate.

Figure 9:
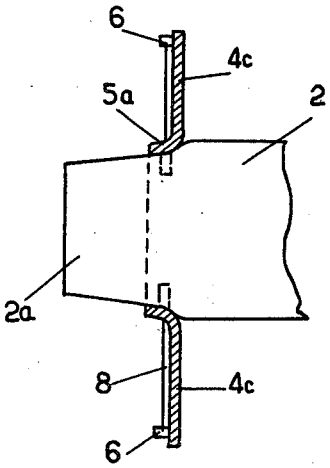
FIG. 9 shows a detail of another embodiment.

In FIG. 9, the reinforcing plate 4c also comprises diagonal ribs 8. At each of its ends, the rung 2 is terminated by a frusto-conical part of reduced section 2a and its end is fitted in the opening 5a of the reinforcing plate 4c which is defined by a frusto-conical recess, the angle of inclination of the wall of this recess being equal to the cone angle of the reduced section portion 2a, with very tight tolerances which may even be negative, in such a manner as to ensure an intimate contact between the rung and the reinforcing plate.

Figure 10:
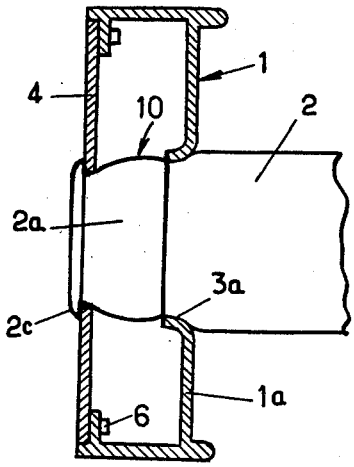
FIG. 10 shows a detail of a further embodiment.

In the embodiment of FIG. 10, the reinforcing plate 4 is disposed on the outside of the stile 1. The reduced section portion end portion 2a of the rung 2 passes through a frusto-conical recess 3a of the web 1a of the stile 1, which is directed towards the outside and of which the cone angle is equal to that of the end portion 2a. The latter is inserted into the opening 5 of the reinforcing plate 4, as indicated at 2c.

When using an angular riveting (peening) machine, it is possible to form on the end portion 2a of the rung a small step which improves the tenacity of the engagement. It is even possible to provide an intermediate bead-like portion 10 extending between the reinforcing plate 4 and the recess 3a, or the flange 1, if there is no recess. This arrangement contributes to the absorption of the loads supported by the web 1, or the reinforcing plate if the latter is disposed on the inner side of the stile, in the case where the forces are abnormally high on the ladder.

Figure 11:
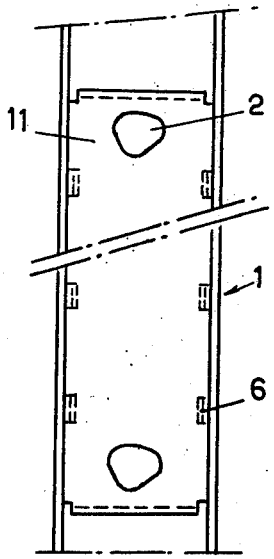
FIG. 11 is a view in elevation of the central part of a ladder in which a common reinforcing plate extends over two or more rungs.

In the embodiment of FIG. 11, a common reinforcing plate 11, with its tabs 6, extends over two or more rungs 2, in the central part of the ladder.

Figure 12:
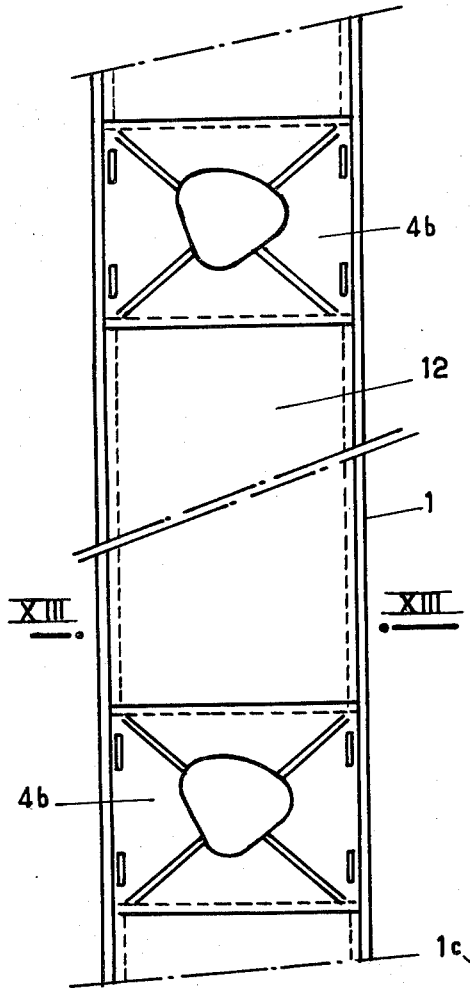
FIG. 12 is a view similar to that of FIG. 11 of a ladder in which a blanking piece is disposed between two reinforcing plates.
Figure 13:
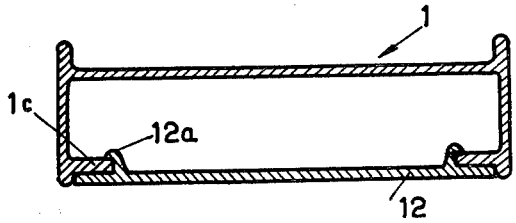
FIG. 13 is a section on line XIII—XIII of FIG. 12.

In the embodiment of FIGS. 12 and 13, reinforcing plates 4b have been provided which are as shown in FIG. 7, and disposed on the inner part of stiles of the ladder. A blanking piece 12 extends between the two reinforcing plates, substantially in their plane, and is held in the stile 1 by teeth 12a which are engaged behind the flanges 1c of the stile. The length of this blanking piece is equal to the space between the two reinforcing plates so that they cannot slide longitudinally with respect to the stile.

Figure 14:
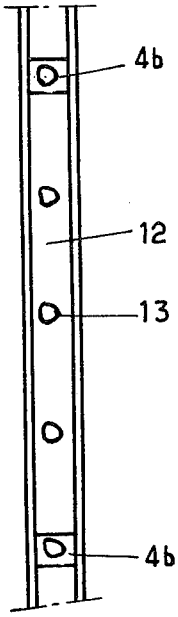
FIG. 14 is a view similar to FIG. 12 of a ladder in which the blanking piece extends over several rungs.

The blanking piece 12 may extend between two reinforcing plates between which there are rungs for which there is no corresponding reinforcing plate, as is shown in FIG. 14. In this case, the blanking piece must be provided with openings 13 for the passage of these rungs.

Figure 15:
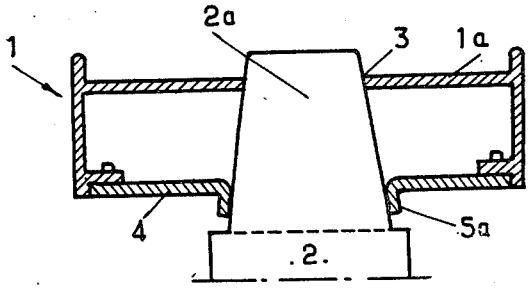
FIG. 15 is a view similar to FIG. 10, before the engagement of the rung.

In the embodiment of FIG. 15, the opening of the reinforcing plate 4 is constituted by a recess 5a which is directed inwardly of the ladder, and is in the form of a funnel, which facilitates the introduction of the rung into the reinforcing plate. The end portion of the rung comprises a frusto-conical reduced section portion 2a. The recess 5a has dimensions substantially larger than those of the end of the rung, which facilitates the introduction of the rung. However, the frusto-conical reduced section portion limits play and the periphery of the recess lies in contact with the outside of the rung during fitting.

Figure 16:
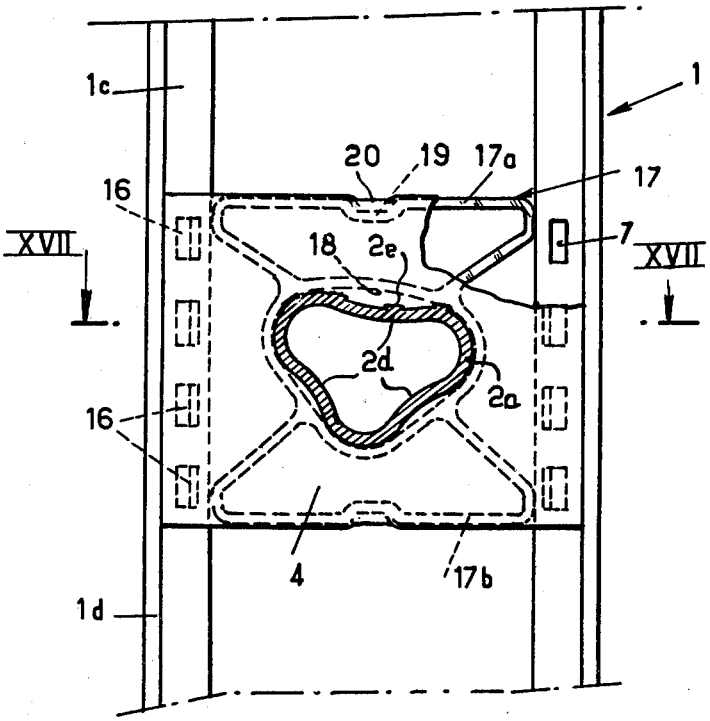
FIG. 16 is a view in section of a still further embodiment.

In FIG. 16, a stile 1 is shown which is constituted by a member of U or of I section, of which the central part 1a is provided with openings 3 for the passage of rungs 2, and of which each of the lateral walls 1b is provided with a flange 1c parallel to the part 1a, this flange being placed inwardly so as to form, beyond it, a rib 1d. Each of the rungs 2 has a triangular section with rounded angles and its end portion 2a is of reduced section over a length slightly in excess of the spacing between the reinforcing plate 4 and the web of the stile 1; its end edge is inserted into the interior of the web 1a, as is to be seen at 2b.

The reinforcing plate 4, which is disposed inwardly of the profiled member, rests on the flanges 1c while extending from one ridge 1d to the other, and is provided with an opening 5 for the passage of a rung 2. This reinforcing plate is constituted by a profiled member which has on one of its longitudinal faces two projecting ribs. These ribs have been cut so as to form teeth 16. These teeth 16 are engaged in the openings 7 which are formed in the flanges 1c; after fitting the reinforcing plate, these teeth are bent over inwardly or outwardly of the stile.

Each end portion of reduced section 2a of the rung 2, instead of having a shape which is similar to that of the rung proper, has a depression 2d in each of its ends, corresponding to a substantially plane part of the cross-section of the rung 2. Its profile thus has, in fact, no straight line part, which enables the provision of a locking arrangement 2b, which is effective over its whole length. The opening 3 has, it should be understood, a corresponding shape.

Between the web of the stile 1 and the reinforcing plate 4 there is interposed a spacer 17 which may be of metal or of plastics material and of which the thickness is equal to the distance between the web and the reinforcing plate. This spacer comprises at its center a hole 18 of which the shape and the dimensions are those of the outer profile of the reduced diameter portion of the rung 2, so that this end is tightly fitted.

Figure 17:
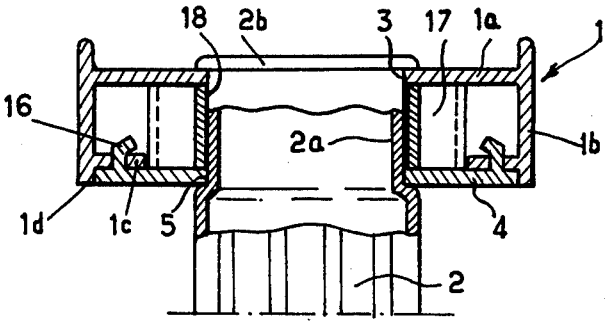
FIG. 17 is a transverse section on the line XVII—XVII of FIG. 16.

In the embodiment of FIGS. 16 and 17, the spacer 17 is metallic and cut or sawn to the desired length. It extends over a height substantially equal to that of the reinforcing plate 4, as can be seen in FIG. 16. It is cut-away both above and below the hole 18; its upper faces 17a and lower faces 17b are relatively thin, and have a width substantially equal to the distance between the flanges 1c of the stiles 1. Each of these faces has at its middle an inwardly spaced rib 19. This rib stiffens the face 17a or 17b and prevents its distortion. It facilitates, moreover, the assembly of the ladder; in practice, during the assembly, it supports first of all the reinforcing plates and the spacers 17 on the stiles 1 by displacing the metal of the reinforcing plate into the rib 19; as indicated at 20, the spacer is secured below the reinforcing plate; the tabs 16 are then bent over. It is then possible to thread the rungs 2 into the stiles thus prepared, and then to proceed to riveting or peening at 2b.

Figure 18:
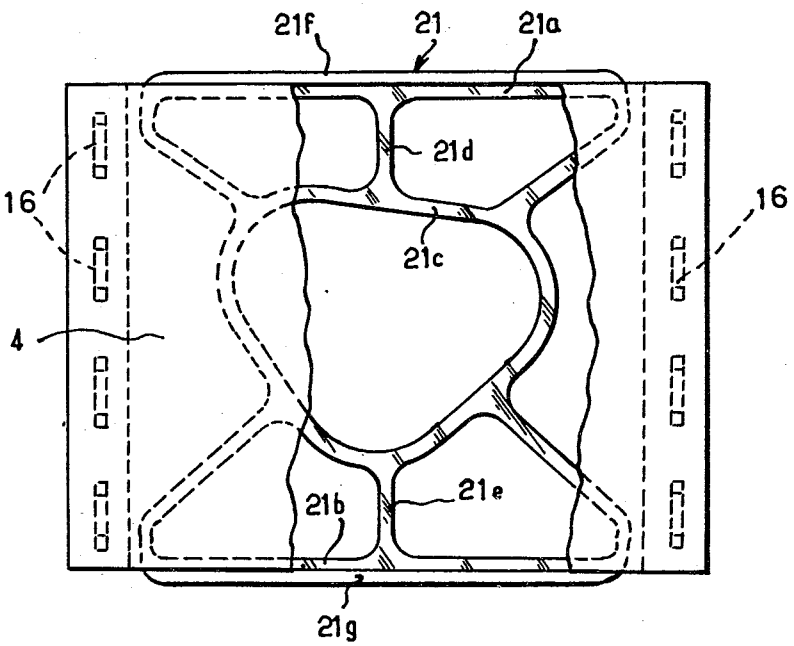
FIG. 18 is an elevational view, partly cut-away, showing another embodiment of a spacer and of a reinforcing plate which covers it.
Figure 19:
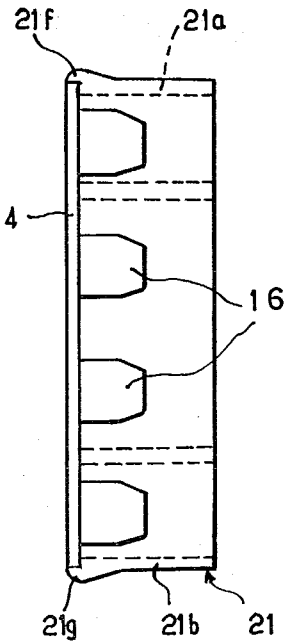
FIG. 19 is a side view of the spacer of FIG. 18.

In the embodiment of FIGS. 18 and 19, the spacer 21 is of moulded plastics material. It has a shape which is similar in its overall concept to that of the spacer 17, but its upper faces 21a and lower faces 21b are connected to the central part 21c substantially at their centers, by reinforcements 21d and 21e which prevent buckling or distortion at these faces when a high force is applied to the spacer. Moreover, the faces 21a and 21b have on their edges directed towards the reinforcing plate 4 a bead 21f, 21g respectively, of which the thickness is substantially equal to that of the web of the reinforcing plate. The two beads define a recess in which the reinforcing plate is encastré, so that the edges are not liable to damage the hands of the user.

We claim:

1. A metal ladder comprising two spaced stiles of open section, a plurality of rungs extending between the stiles, and having a shoulder at each end, and reinforcing plates each receiving an end portion of a rung in an opening thereof, and each including tab means, each said stile having a web, with openings for the rungs, two longitudinal walls, one wall extending from each edge of the web, and each longitudinal wall having a flange spaced inwardly from the free edge of the longitudinal wall so as to define a ridge, each said flange having apertures therein spaced along its length, each said rung being fitted in a said opening of the web and in a said opening of a said reinforcing plate, and the tab means of the reinforcing plates being secured in the apertures of the flanges.

2. A ladder according to claim 1, wherein each reinforcing plate is disposed on the inside of each stile, so that the rungs first traverse the reinforcing plate, and then the web of the stile.

3. A ladder according to claim 1, wherein the tab means have the same width as the apertures in the flanges.

4. A ladder according to claim 1, wherein transverse edges of the reinforcing plate comprises a fold portion substantially perpendicular to the plate.

5. A ladder according to claim 1, wherein the reinforcing plate comprises stiffening ribs arrayed substantially diagonally.

6. A ladder according to claim 1, wherein the opening in the reinforcing plate is formed by a recess having a depth greater than the thickness of the plate.

7. A ladder according to claim 1, wherein each shoulder is constituted by a reduced section portion formed at each end of the rung over a length somewhat in excess of the distance separating the reinforcing plate from the web of the stile.

8. A ladder according to claim 1, wherein a common said reinforcing plate extends over at least two rungs of the ladder.

9. A ladder according to claim 1, comprising a blanking piece which extends between two said reinforcing plates and is engaged in the corresponding stile, the length of this blanking piece being equal to the space between the two reinforcing plates.

10. A ladder according to one of claim 1 wherein each end of the rung has a reduced section portion, with a longitudinal depression in each of its parts corresponding to a substantially plane part of the rung.

11. A ladder according to claim 1, comprising a spacer of which the thickness is substantially equal to the distance between the reinforcing plate and the web of the stile and is disposed between the reinforcing plate and the web and is threaded on the end portion of the rung.

12. A ladder according to claim 11, wherein the upper faces and lower faces of the spacer have a width substantially equal to the spacing between the stiles of the ladder.

* * * * *